US011427387B2

(12) United States Patent
Werp, II

(10) Patent No.: US 11,427,387 B2
(45) Date of Patent: Aug. 30, 2022

(54) CHILD-RESISTANT BOTTLE CAP OVERSHELL AND METHOD OF CONSTRUCTION THEREOF

(71) Applicant: Sorse Technology Corporation, Seattle, WA (US)

(72) Inventor: Peter Casimir Werp, II, Seattle, WA (US)

(73) Assignee: Sorse Technology Corporation, Seattle, WA (US)

( * ) Notice: Subject to any disclaimer, the term of this patent is extended or adjusted under 35 U.S.C. 154(b) by 59 days.

(21) Appl. No.: 16/943,023

(22) Filed: Jul. 30, 2020

(65) Prior Publication Data

US 2021/0031990 A1 Feb. 4, 2021

Related U.S. Application Data

(60) Provisional application No. 62/880,561, filed on Jul. 30, 2019.

(51) Int. Cl.
*B65D 50/04* (2006.01)
*B65D 41/34* (2006.01)

(52) U.S. Cl.
CPC ..... *B65D 50/048* (2013.01); *B65D 41/3404* (2013.01); *B65D 2215/02* (2013.01)

(58) Field of Classification Search
CPC .. B65D 50/067; B65D 50/046; B65D 50/048; B65D 50/045; B65D 50/04; B65D 51/24; B65D 51/18; B65D 83/40; B65D 41/3404; B65D 41/34; B65D 41/32; B65D 41/06; B65D 41/04
USPC ..... 215/222, 217, 215, 201, 228; 222/153.1, 222/153.09; 220/293, 288, 212
See application file for complete search history.

(56) References Cited

U.S. PATENT DOCUMENTS

| | | | | |
|---|---|---|---|---|
| 3,097,756 A * | 7/1963 | Dorsey | B65D 50/068 215/215 |
| 3,871,544 A * | 3/1975 | Peyser | B65D 50/045 215/225 |
| 3,934,744 A | 1/1976 | Curry | |
| 3,951,290 A | 4/1976 | Montgomery | |
| 4,522,307 A | 6/1985 | Steiner | |
| 5,040,694 A * | 8/1991 | Gambello | B65D 83/40 220/255 |
| 6,604,643 B1 * | 8/2003 | Michael | B65D 50/067 215/204 |

FOREIGN PATENT DOCUMENTS

| | | |
|---|---|---|
| CH | 484789 | 1/1970 |

* cited by examiner

*Primary Examiner* — Robert J Hicks
(74) *Attorney, Agent, or Firm* — Krista A. Wittman

(57) ABSTRACT

A child-resistant bottle cap overshell and method for construction thereof is provided. A top cover has a rounded shape. A body extends from an outer perimeter of the top cover and is sized to fit over a bottle cap on a bottle. At least two cutouts are formed in the top cover adjacent to the outer perimeter. A plurality of ridges are formed on an inner surface of the body on a bottom end opposite the top cover.

20 Claims, 15 Drawing Sheets

PRIOR ART

PRIOR ART

CHILD-RESISTANT BOTTLE CAP OVERSHELL AND METHOD OF CONSTRUCTION THEREOF

CROSS-REFERENCE TO RELATED APPLICATION

This non-provisional patent application claims priority under 35 U.S.C. § 119(e) to U.S. Provisional Patent application, Ser. No. 62/880,561, filed Jul. 30, 2019, the disclosure of which is incorporated by reference.

FIELD

This application relates in general to a safety bottle cap, and in particular to a child-resistant bottle cap overshell and method of construction thereof.

BACKGROUND

As cannabis becomes legal in more and more states, there has been an increase in edible products, such as foods and beverages that contain cannabis. Currently, the sale of such products is heavily regulated and generally requires purchase from a store licensed to sell cannabis products, as well as strict adherence to packaging requirements to prevent accidental consumption by unintending consumers or accidental overconsumption.

However, once the edible product is purchased, care must be taken to ensure that cannabis containing products are not accessible to children, pets, or other individuals not intending to ingest cannabis if the product is not immediately consumed or not consumed in a single sitting. For example, all food and beverage products with cannabis must be clearly labeled as a cannabis product. However, young children, even if able to read, may not understand the label. Further, edible cannabis products often resemble non-cannabis food and beverage products despite the strict packaging regulations with witch edible cannabis products must conform.

Child-resistant packaging can be utilized to prevent unintended ingestion of cannabis products, and at a minimum, the packing should allow for reuse so that an edible cannabis product can be consumed at different times to prevent overuse. Carbonated beverages can be packaged in an aluminum can for consumption in a single sitting or in a plastic bottle with a resealable cap that allows for consumption over a period of time. A carbonated beverage with cannabis that is intended to be consumed over time should have a resealable cap that retains carbonation and that is also child-resistant to prevent accidental consumption. However, currently and in the past, there has been no need to make a carbonated beverage vessel that is child-resistant since such beverages generally include carbonated water and soda, or other liquids that are not harmful to children.

Similar to carbonated beverages with cannabis, medicine should also be difficult for children and other individuals to access and most medicines are packaged in resealable containers with child-resistant closures. For example, U.S. Pat. No. 3,951,290, to Montgomery, discloses a child-resistant overcap that is positioned over a threaded screw cap of a medicine bottle or a bottle with one or more chemicals. The overcap includes two diametric pairs of openings on a top surface of the overcap and two sets of driving ribs that are formed circumferentially around an inner surface of the overcap, below the top surface. The ribs of the overcap are substantially complementary to a series of friction ribs on the cap. However, such overcap is customized for medicine and chemical bottles and fails to consider bottles with carbonated beverages, which cause additional pressure to form within the bottle and make removal of the cap more difficult. Additionally, the overcap of Montgomery is intended to work with screw caps that include threading near a top surface of the screw cap.

Accordingly, what is needed is a child-resistant, resealable closing system. Preferably, such closing system includes a resealable lid that helps prevent carbonation loss and prevents easy opening.

SUMMARY

A child-resistant closing system can include a bottle cap and an overshell that fits over the bottle cap. In one embodiment, the overshell fits loosely over the cap of a bottle, but is secured to the bottle via teeth that grip the mouth of a bottle. Specifically, the overshell can include a top cover and a body that extends downward from the top cover. One or more windows can be formed within the top cover of the overshell to provide flexibility and allow movement of the overshell when pressure is applied. Further, teeth can be formed along a portion of the overshell interior to engage with grooves on the bottle cap during opening of the bottle cap. Little children and adults will notice that the bottle is difficult, if not impossible, to open unless a certain amount of pressure is applied to the overshell, which can help unintended consumption of the bottle's contents.

An embodiment provides a child-resistant bottle cap overshell. A top cover has a rounded shape. A body extends from an outer perimeter of the top cover and is sized to fit over a bottle cap on a bottle. At least two cutouts are formed in the top cover adjacent to the outer perimeter. A plurality of ridges is formed on an inner surface of the body on a bottom end opposite the top cover.

A further embodiment provides a method for constructing a child-resistant bottle cap overshell. A top cover with a rounded shape is formed. A body is affixed to an outer perimeter of the top cover. The body extends away from the top cover and is sized to fit over a bottle cap on a bottle. At least two cutouts are formed within the top cover adjacent to the outer perimeter. A plurality of ridges are affixed on an inner surface of the body on a bottom end opposite the top cover.

Still other embodiments will become readily apparent to those skilled in the art from the following detailed description, wherein are described embodiments by way of illustrating the best mode contemplated. As will be realized, other and different embodiments are possible and the embodiments' several details are capable of modifications in various obvious respects, all without departing from their spirit and the scope. Accordingly, the drawings and detailed description are to be regarded as illustrative in nature and not as restrictive.

DETAILED DESCRIPTION

Edible products that include cannabis are becoming extremely popular as more and more states legalize cannabis. Despite the legalization, cannabis products should be carefully monitored and stored to prevent accidental ingestion by children and other individuals. A child-resistant bottle cap overshell can be used on resealable bottles with carbonated and non-carbonated beverages. Specifically, the overshell is placed over a standard bottle cap and makes opening the bottle more difficult to prevent unintended consumption of contents in the bottle, while still allowing the cap to be resealed.

Figure 1A:
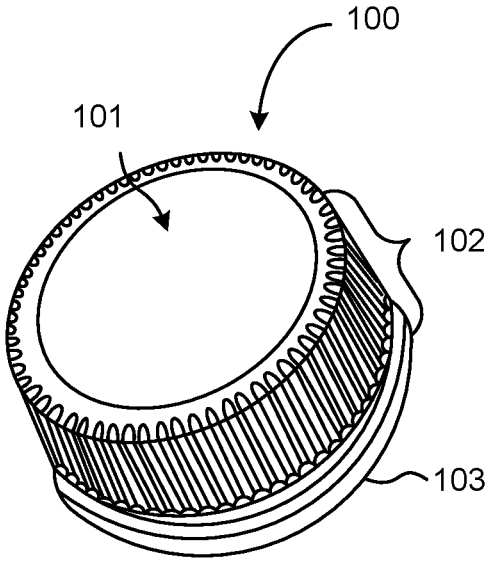
FIG. 1A is a block diagram showing top perspective view of a prior art bottle cap.

The bottle cap over which the overshell is placed can be a standard bottle cap generally used on soda or carbonated water bottles. FIG. 1A is a block diagram showing a top perspective view of a prior art bottle cap 100. The bottle cap 100 includes a circular top surface 101 with a circular skirt 102 extending down from a perimeter of the top surface. An outer surface of the skirt 102 can include ridges and grooves, which can provide grip for a user when opening the bottle cap 100 by twisting the cap in one direction. The bottle cap 100 can be a plastic closure only (PCO) cap or a different type of cap.

Figure 1B:
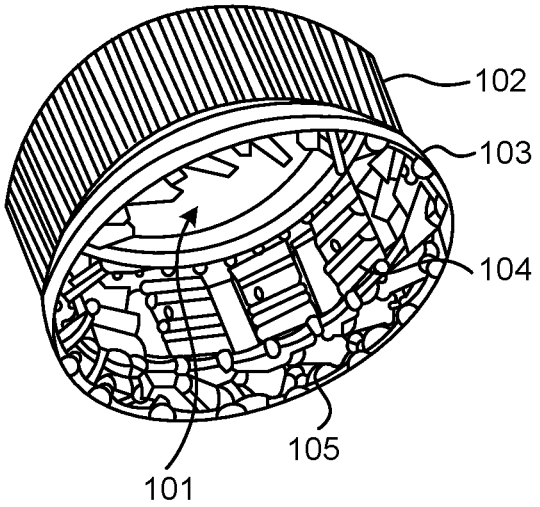
PRIOR ART Fig. 1B.
FIG. 1B is a block diagram showing a bottom perspective view of the prior art bottle cap 100 of FIG. 1A.
Figure 1C:
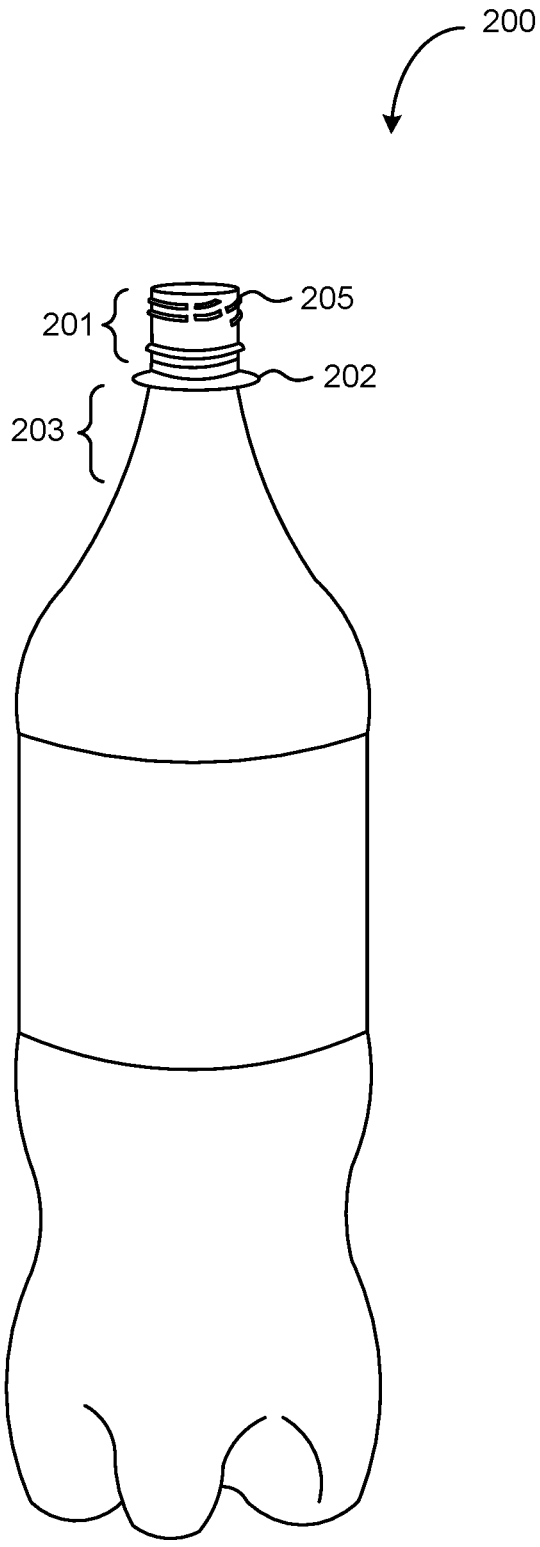
FIG. 1C is a block diagram showing a side view of a prior art bottle.

The bottle cap can be securely affixed to a bottle via threading. FIG. 1B is a block diagram showing a bottom perspective view of the prior art bottle cap 100 of FIG. 1A. An inner surface of the circular skirt 102 can include threading 104 that corresponds with external threading on a neck of a bottle on which the cap is used. FIG. 1C is a block diagram showing a side view of a prior art bottle 200. The bottle 200 can include a neck finish 201, neck ring 202, neck 203, and body 204. The neck finish 201 can include threading 205 that corresponds with the threading on the bottle cap (not shown) to ensure that the bottle cap is securely affixed to the bottle to maintain carbonation and freshness of the bottle contents.

Returning to the discussion with respect to FIG. 1B, a bottom of the skirt 102, opposite the circular top surface 101, can be removably affixed to a tamper proof ring 103. An inner surface of the tamper proof ring can include teeth 105 that extend outward away from the ring, and into an interior of the bottle cap 100, to grip the bottle so the bottle cap can be removed from the bottle while the tamper proof ring remains.

Figure 2:
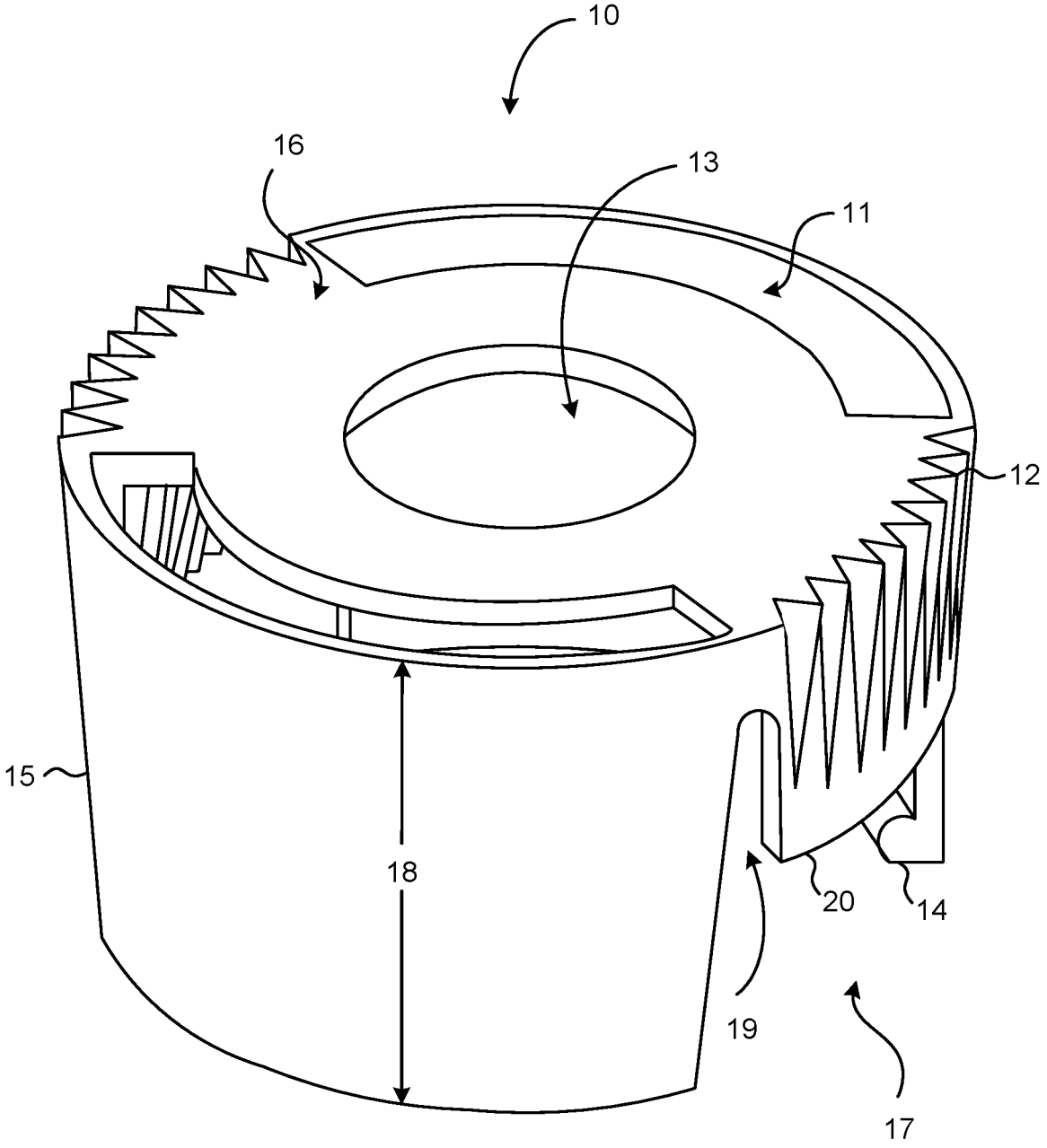
FIG. 2 is a block diagram showing, by way of example, a perspective view of a child-resistant bottle cap overshell.

An overshell can be placed over a bottle cap to prevent the bottle cap from being easily removed from a bottle. FIG. 2 is a block diagram showing, by way of example, a perspective view of a child-resistant bottle cap overshell 10. The overshell 10 can include a cylindrical body 15 with a top cover 16 on one end of the cylindrical body 15. In one embodiment, the body 15 can have the same height 18 all the way around the top cover 16. However, in a further embodiment, the body 15 can have different heights 18. The areas of the body with shorter heights can form a void or cutout 17 in the cylindrical body 10. Further, a notch 19 can be formed between portions of the body 15 that are full height and partial height 20.

The top cover 16 can include two or more cutout windows 11 that are located opposite one another and can be shaped in an arc. However, other shapes, such as semi-circles or crescents are also possible. In a further embodiment, a single window can be provided, such as around half of the top cover to provide windows on opposing sides of the overshell. The top cover 16 can also include a circular opening 13 in a center of the top cover, which can be used to identify the bottle (not shown) on which the overshell is placed, such as via the top of the cap on the bottle. A ribbed closure 12 can be provided between each of the windows 11 and each ribbed closure can include a series of vertical grooves and ridges that extend from an outward facing surface of the top cover 11, downward along the outer surface of the body 15. The ribbed closure 12 can extend from the top surface of the top cover all the way to the bottom of the body or can extend along a portion of the body height. In one embodiment, the ribbed closure 12 can extend along portions of the body 15 with a shorter height 20. Raised bands of the ribbed closures 12 can be straight, pointed or rounded, and allow a user to establish a grip of the overshell 10 to open the bottle cap on which the overshell is placed.

A flange 14 is affixed perpendicularly to a bottom edge of the body 15 and extends into an interior of the overshell 10. The flange can extend fully or partially around a circumference of the bottom edge of the body 15 when the body is the same height. Alternatively, when there are portions of the body that are different heights, the flange 14 can extend along only those portions of the body that are full length. Further, the flange 14 can be continuous or can include discontinuous segments. The flange 14 functions to fit within a small gap between the tamper proof ring of a bottle cap and the neck ring (shown in FIG. 1C as reference number 202) of a bottle on which the tamper proof ring is placed or underneath the neck ring.

Figure 3:
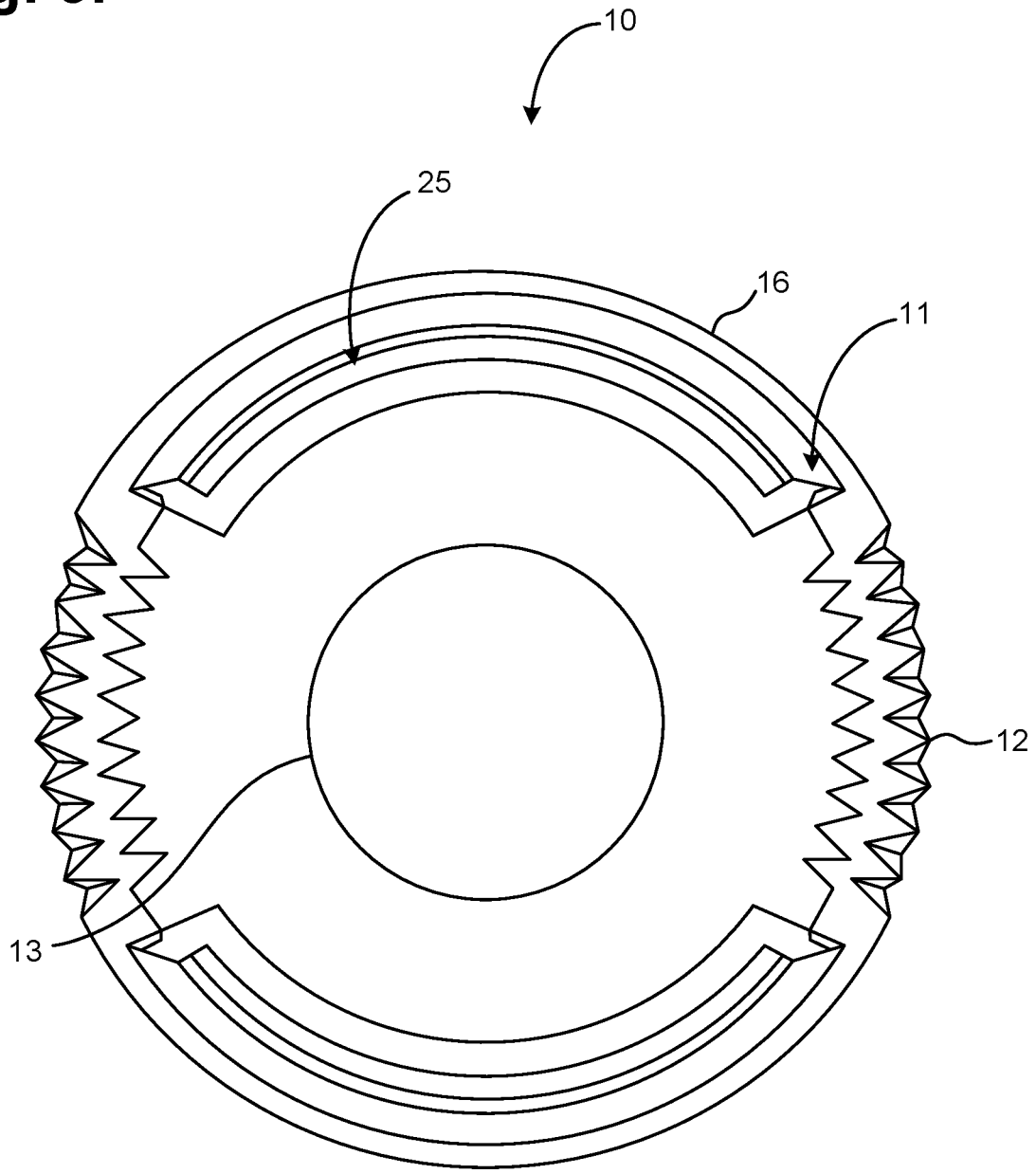
FIG. 3 is a block diagram showing, by way of example, a top view of the child-resistant bottle cap overshell of FIG. 2.

The bottle on which the overshell is placed can be identified, such as through windows in the top cover 16. FIG. 3 is a block diagram showing, by way of example, a top view of the child-resistant bottle cap overshell 10 of FIG. 2. The top cover 16 can include one or more windows 11, such as in a shape of an arc. The windows 11 can each provide a void 25 that allows a user to view an outer perimeter of a bottle cap on which the overshell is placed. In one embodiment, there are two windows that are located directly across from one another. Ribbed closures 12 can be provided along a perimeter of the top cover. In one embodiment, two sets of ribbed closures 12 can be positioned, with each ribbed closure located in between two of the windows. The top cover 16 can also include a circular opening 13 in a center of the top cover 16 to view the bottle cap (not shown) on which the overshell is placed.

Figure 4:
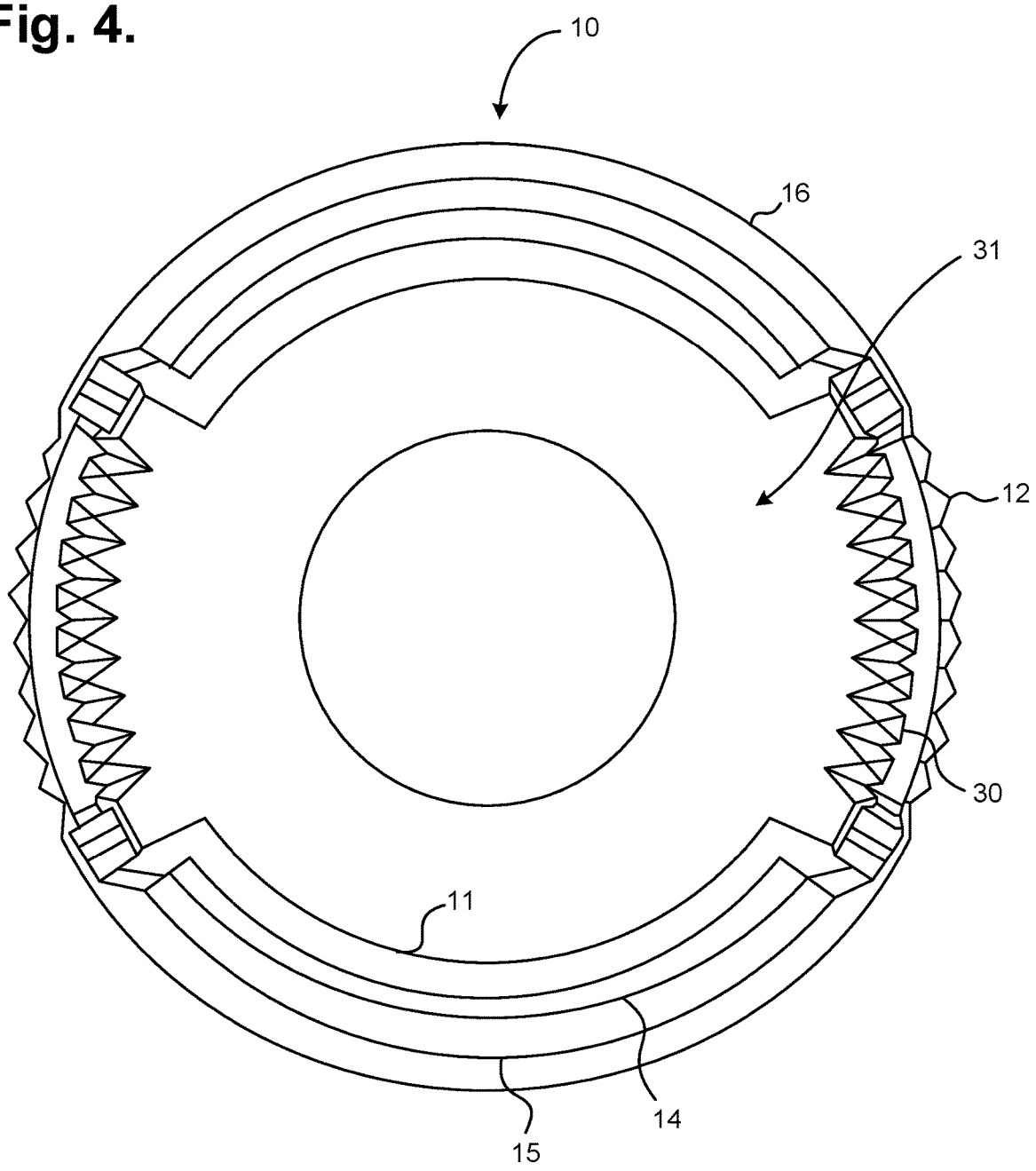
FIG. 4 is a block diagram showing, by way of example, a bottom view of the child-resistant bottle cap overshell of FIG. 2.

An interior of the overshell can be viewed from a bottom side of the overshell. FIG. 4 is a block diagram showing, by way of example, a bottom view of the child-resistant bottle cap overshell 10 of FIG. 2. From a bottom of the overshell 10, an interior surface 31 of the overshell can be viewed. Teeth 30 can protrude from an inner surface of the body 15 into the interior 31 of the overshell 10. The teeth 30 cane formed from the grooves of the ribbed closure 12, while the ridges of the ribbed closure 12 form channels between the teeth 30. Alternatively, the teeth 30 can be formed separate from the ribbed closure, on an interior surface of the overshell. Specifically, the teeth 30 should be shaped according to the grooves on a bottle cap, which are described above in further detail with respect to FIG. 1. The teeth 30 can each protrude into a groove of the bottle cap to engage with the bottle cap during opening. Accordingly, a size of the teeth 30 should be slightly smaller than the grooves to fit within the grooves of the bottle cap.

Figure 5:
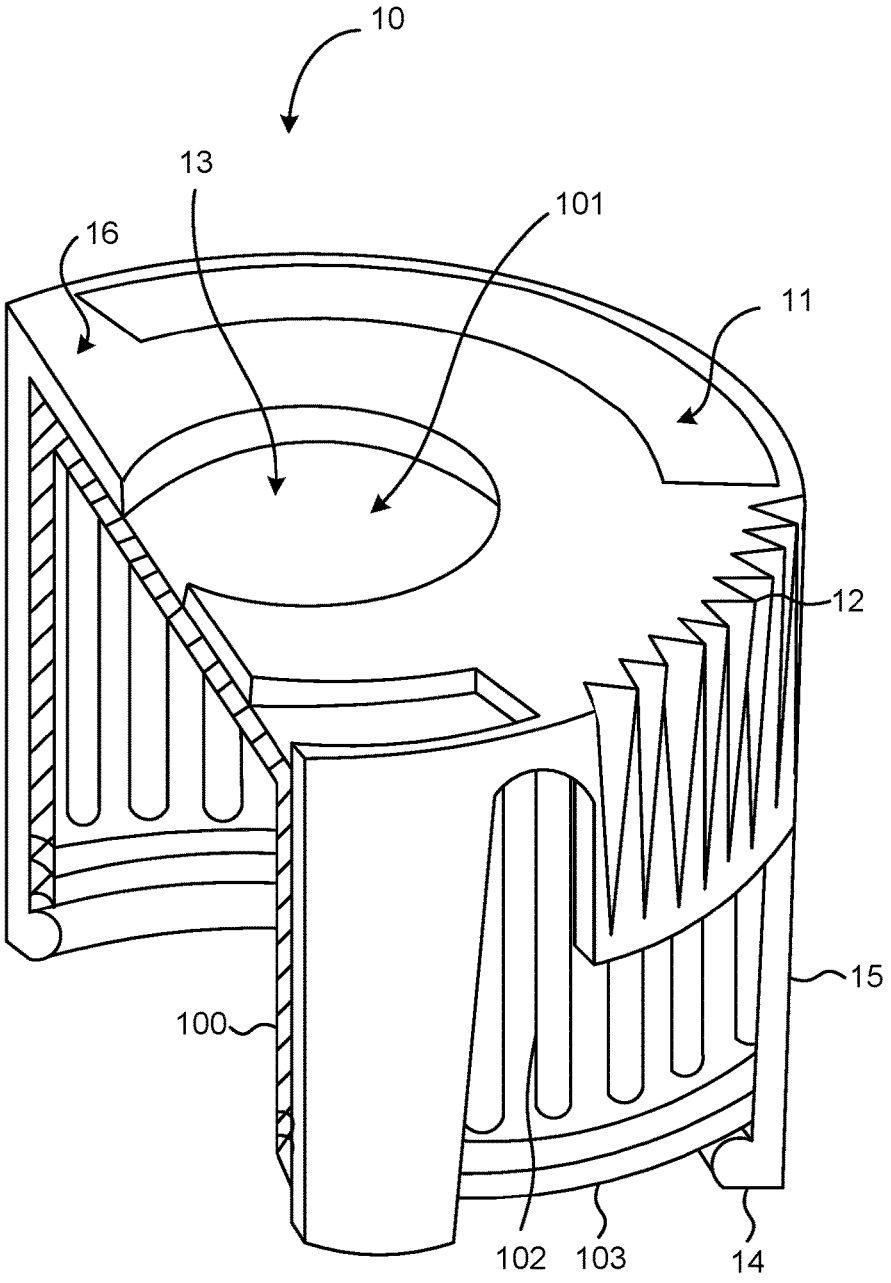
FIG. 5 is a block diagram showing, by way of example, the overshell of FIG. 1 positioned on a bottle cap.

The overshell 10 is placed on top of a bottle cap such that the flanges are positioned under and engage with the tamper proof ring of the bottle cap. When positioned, the overshell fits loosely around the bottle, but is held over the bottle cap based on the flanges. The loose fit of the overshell makes opening the bottle cap more difficult since applying pressure to the bottle cap during opening requires effort of a user. FIG. 5 is a block diagram showing, by way of example, the overshell 10 of FIG. 2 positioned on a bottle cap 100. The overshell 10 is secured to the bottle cap via the flanges 14. Specifically, the flanges are placed under the tamper proof ring of the bottle cap 100 or the neck ring of the bottle (not shown) so the overshell cannot be easily removed.

To open the bottle cap 100, a user presses two sides of the overshell 10 together. Specifically, the user should press the sides of the overshell body with the ribbed closure 12 so that the teeth 30 on an interior of the body are depressed into the grooves on the bottle cap. While, the sides of the overshell are still pressed in, the user can twist the overshell in an open direction, which forces the teeth 30 to press against the ridges of the bottle cap adjacent to the respective groove to open the bottle cap. Flexibility of the overshell to move inward toward the bottle cap is facilitated by the windows 11, which allow easier movement of the overshell 10 when a user squeezes the sides of the top cover. Once the bottle cap 100 is twisted open, the user can release the overshell, which returns to the original shape. The user can take a drink from the bottle and after, replace the bottle cap and overshell on the bottle.

Figure 6:
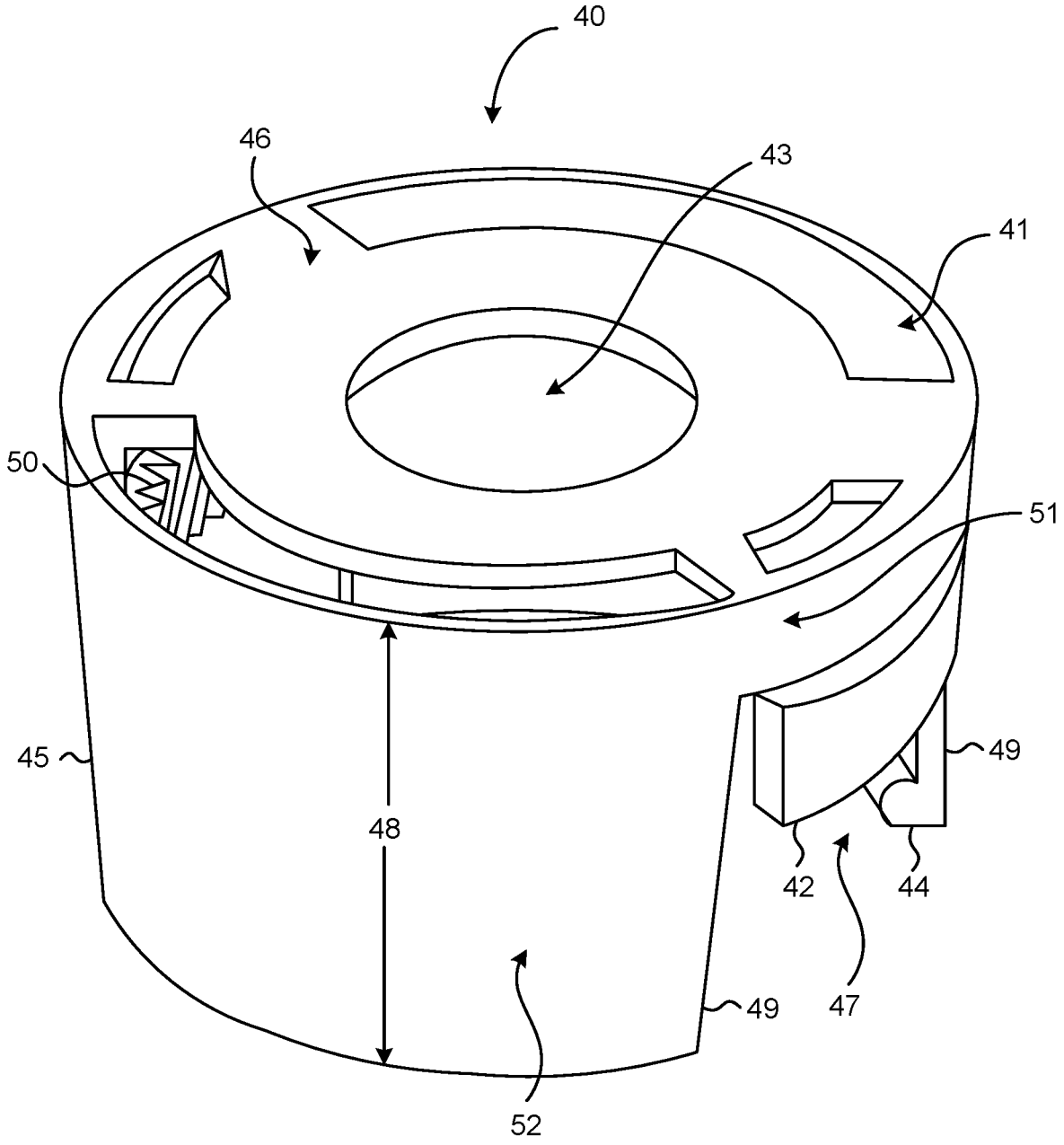
FIG. 6 is a block diagram showing, by way of example, a perspective view of a further child-resistant bottle cap overshell.

Other shapes and features of the overshell are possible. For example, FIG. 6 is a block diagram showing, by way of example, a perspective view of a further child-resistant bottle cap overshell 40. The overshell 40 can include a top cover 46 that in one embodiment, has a circular shape. However, other shapes are possible, such as an ellipse. An opening 43 can be formed within the top cover 46, such as in the center, to allow a user to view the contents of the bottle on which the overshell is placed. In one embodiment, the opening 43 can be shaped as a circle; however, other shapes are possible.

A cylindrical body 45 can extend downward and away from the top cover 46. The body 45 can have the same height 48 all the way around or can have portions with different heights. For example, the body 45 can have two cutouts 47 on opposite sides of the body so that a portion of the body 51 extending downward stops short of the full height 48 of the body. The short portions of the body 51 can be interspersed between full length portions of the body 52.

A bottom side of the full height portions of the body 52 can include a flange 44 along a portion or all of a bottom surface of the bottom side of the body 52. Specifically, the flange 44 extends into the interior of the overshell 40 and fits underneath the bottom surface of a bottle cap when the overshell 40 is placed on a bottle. The overshell 40 is secured to the bottle cap via the flanges 44, which can be positioned under the tamper proof ring of the bottle cap 100 or the neck ring of the bottle (not shown) so the overshell cannot be easily removed.

Figure 7:
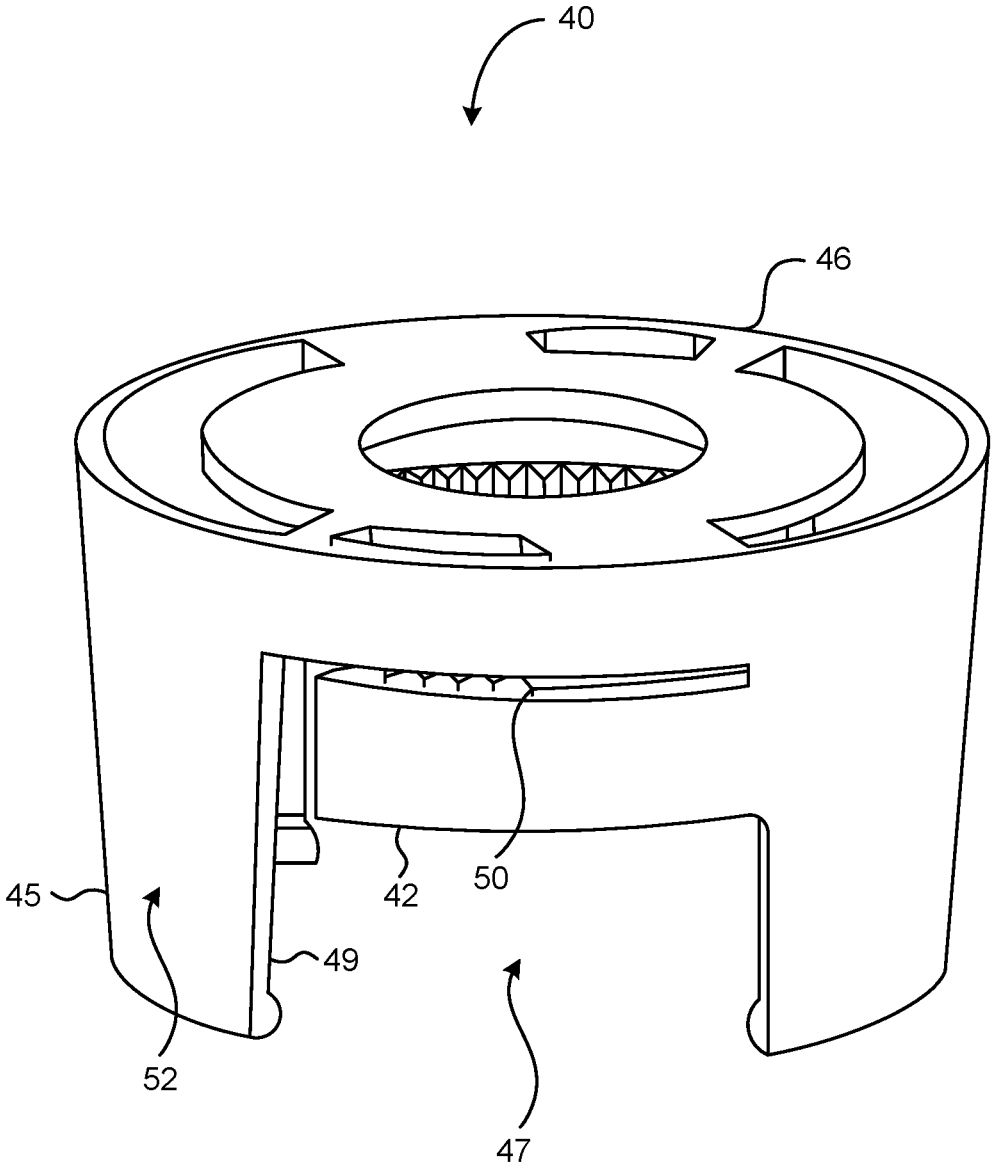
FIG. 7 is a block diagram showing, by way of example, a side view of the further child-resistant bottle cap overshell of FIG. 6.

Within each cutout 47, a tab 42 can extend from an open side 49 of the full portion body 52 towards an open side of the other full portion body 52. The tabs 42 can be rectangular or square in shape, and affixed on one end to the side of one full portion body 52. Other shapes of the tab are possible. FIG. 7 is a block diagram showing, by way of example, a side view of the further child-resistant bottle cap overshell 40 of FIG. 6. The overshell 40 can include a top cover 46, which can be in the shape of a circle, oval, or ellipse, as well as other shapes. A body 45 of the overshell, which extends from a bottom of the top cover 46 can have different heights. Specifically, two portions of the rounded body 45 can have the same full height 52, while two other portions of the body, interspersed between the full height sides, can have a cutout 47, and thus, are shorter than the full height. A tab 42 can be formed within the cutout 47 on one open side 49 of the full body portion and extend into the cutout 47. The tab 42 can be square, rectangular, or oval shaped, as well as other shapes. An interior surface of the tab 42 can have teeth 50 extending outwards into the interior of the overshell 40 to grip a bottle cap as further described below with respect to FIG. 8. The teeth 50 can cover a portion of the tab 42 or all of the tab 42, which connect with the bottle cap during removal of the bottle cap from the bottle.

Figure 8:
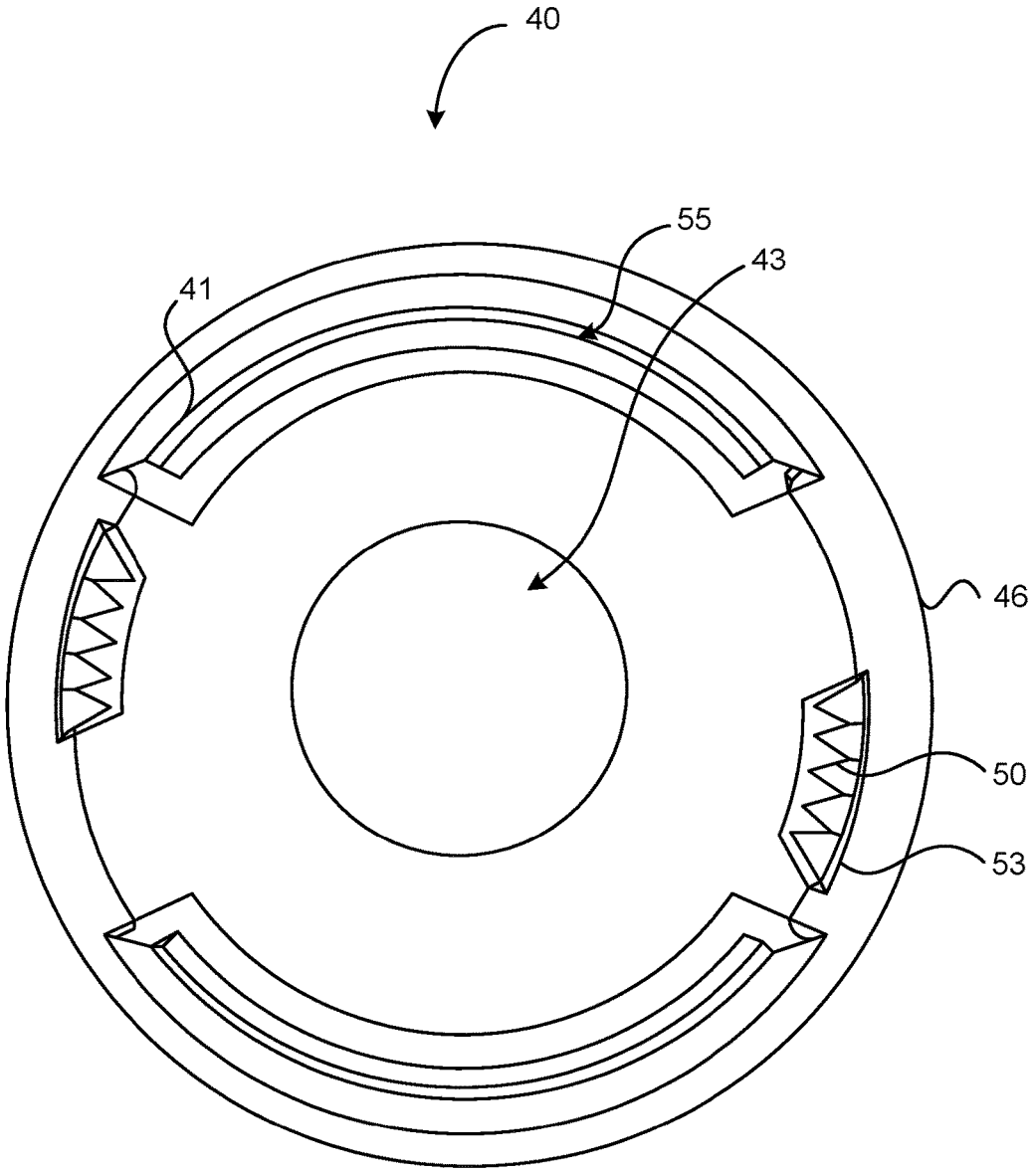
FIG. 8 is a block diagram showing, by way of example, a top view of the further child-resistant bottle cap overshell of FIG. 6.

The top cover 46 includes windows through which the bottle on which the overshell is placed can be identified. FIG. 8 is a block diagram showing, by way of example, a top view of the further child-resistant bottle cap overshell 40 of FIG. 4. The top cover 46 of the overshell 40 can include two or more windows 41. The windows can be the same or different size and can be formed in the shape of an arc or other shape. In one embodiment, two windows 41 can be positioned along an outer edge of the cover, opposite from each other, and can have the same size. In a further embodiment, two additional windows 53 can be formed in the cover 46, one in between each of the first set of two windows 41. The windows 41, 53 can each include a void 55, which allows a user to view an interior of the overshell 40. For example, depending on where the windows are positioned, a user can view, for example, the outer perimeter of a bottle cap on which the overshell is placed and teeth 50 formed on an inner surface of the overshell 40, including the tab, when the overshell is not positioned on a bottle cap. However, the bottle cap can be viewed through the windows 41, 53 when the overshell is placed on the bottle cap.

Figure 9:
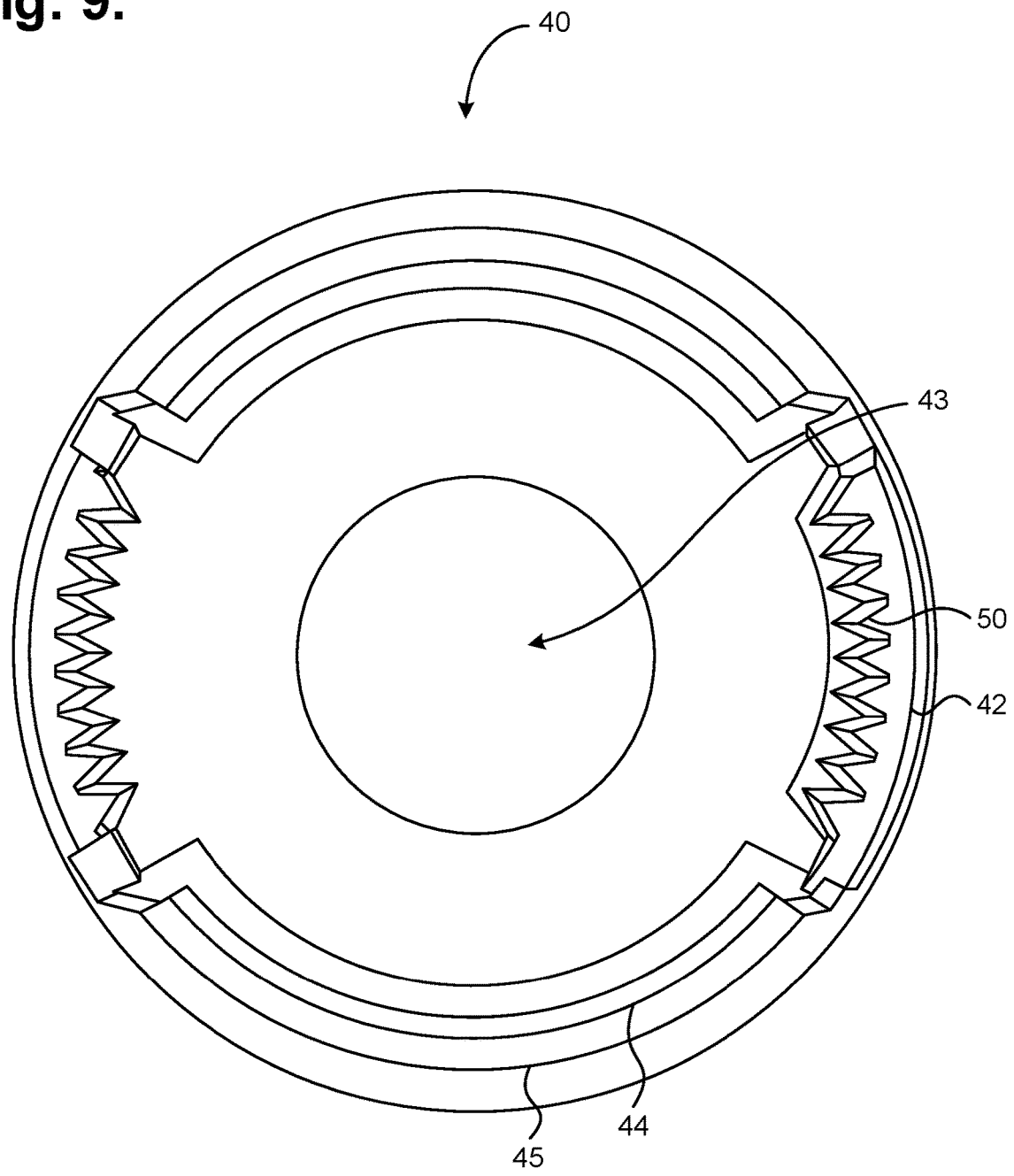
FIG. 9 is a block diagram showing, by way of example, a bottom view of the further child-resistant bottle cap overshell of FIG. 6.

The windows provide flexibility to the overshell 40 and allow the overshell 40 to bend when pressed or squeezed by a user during removal of the bottle cap from a bottle, as further described below with reference to FIG. 9. In one embodiment, ribbed closures (not shown) can be provided along an outer perimeter of the top cover to provide grip to a user. The top cover 46 can also include a circular opening in a center of the top cover 16 to view the bottle cap on which the overshell is placed.

During removal, the teeth formed on an interior of the overshell are used to connect with the cap of a bottle for removal. FIG. 9 is a block diagram showing, by way of example, a bottom view of the further child-resistant bottle cap overshell of FIG. 4. From a bottom of the overshell 40, an interior surface of the overshell can be viewed. Teeth 50 can be provided on an inner surface of the body 15, such as on the tabs 42, and protrude from an inner surface of the body into the interior of the overshell 40. The teeth 50 can be shaped according to the grooves on a bottle cap, which are described above in further detail with respect to FIGS. 1A-1C.

To twist open the bottle cap, a user presses two sides of the overshell 40 together. Specifically, the user can press the tabs 42 so that the teeth 50 on the tabs are depressed into the grooves on the bottle cap. Each tooth 50 is sized to protrude into a groove of the bottle cap. For example, a size of the teeth 50 should be slightly smaller than the grooves to fit within the grooves of the bottle cap. When the tabs 42 are pressed in towards the bottle cap during opening, the teeth 50 engage the grooves and provides a grip on the bottle cap. While, the tabs are still pressed in, the user can twist the overshell 40 in a direction for opening, which forces the teeth 30 to press against the ridges of the bottle cap adjacent to the respective groove to open the bottle cap. Flexibility of the overshell 40 and tabs to move inward toward the bottle cap is facilitated by the windows (not shown), which allow easier movement of the overshell 40 when a user squeezes the sides of the tabs. When the shape of the overshell is an ellipse, pressure on the body sides can allow the circumference to become circular, such as when squeezed. Also, once pressure on the overshell is released, the overshell body springs back to the original shape.

The overshell 40, when placed over a bottle cap, makes opening the bottle cap more difficult since the overshell fits securely, but loosely around the bottle cap, making the bottle cap difficult to grip via the overshell. Meanwhile, when no pressure is applied to the tabs, the overshell fits loosely over the bottle cap and the teeth 50 may lightly touch the grooves of the bottle cap, but are not engaged until pressure is applied to the tabs.

Figure 10:
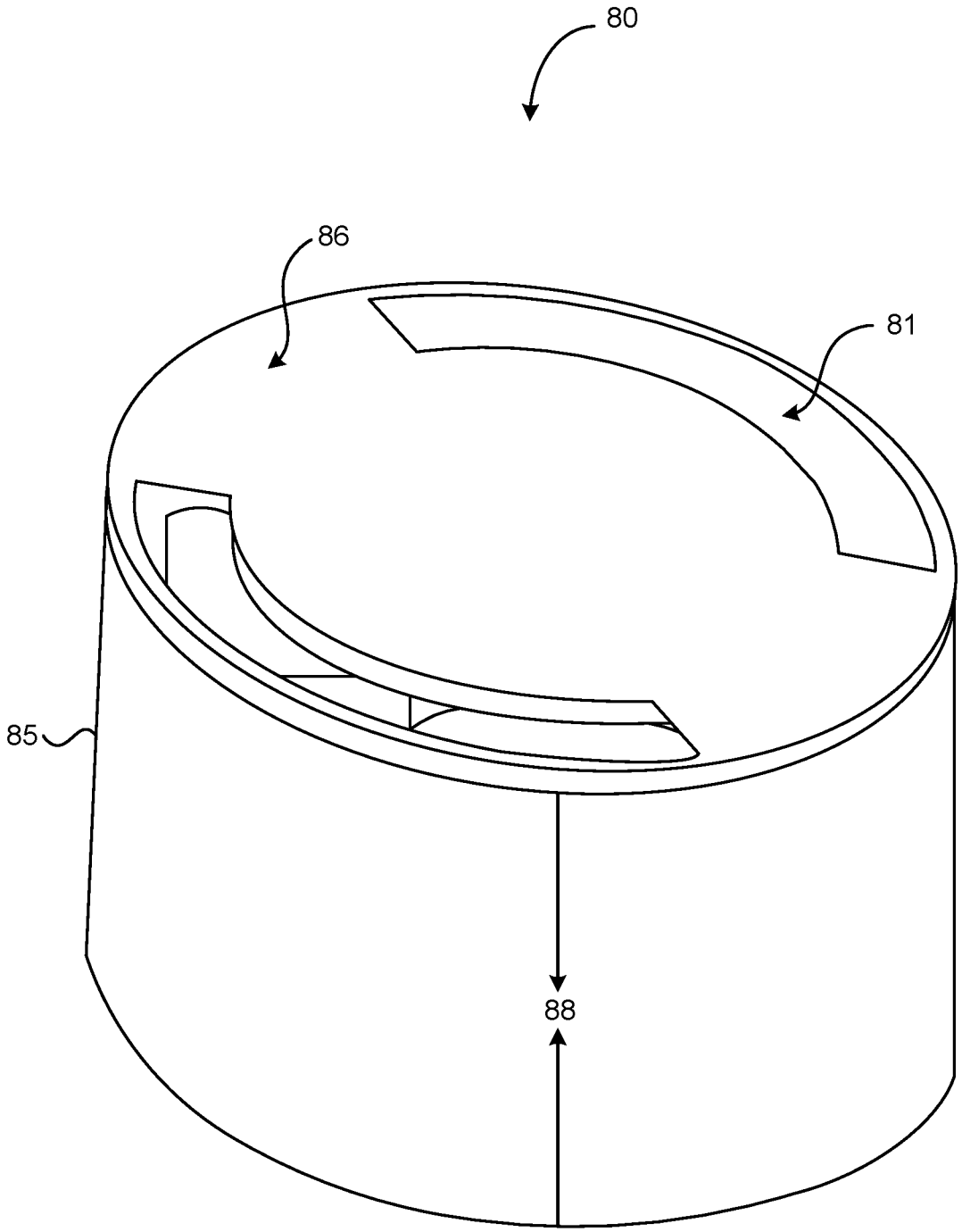
FIG. 10 is a block diagram showing, by way of example, a top perspective view of a further child-resistant bottle cap overshell.

The overshell can have different shapes and configurations. FIG. 10 is a top perspective view showing, by way of example, a further child-resistant bottle cap overshell 80. The overshell 80 can have a circular or oval shape and can include a top cover 86 with a cylindrical body 85. Specifically, the body 85 extends from an outer edge of the top cover 84 and extends downward. In one embodiment, the body 85 can have the same height 88 all the way around the top cover 86. However, in a further embodiment, the body 85 can have different heights 88.

The top cover 86 can include two or more cutout windows 81 that are located opposite one another and can be shaped in an arc. However, other shapes, such as semi-circles or crescents of the windows, placement of the windows, and numbers of the windows are also possible. The top cover 86 can also optionally include an opening (not shown) in a center of the top cover, which can be used to identify the bottle such as via the top of the bottle cap on which the overshell 10 is placed. A ribbed closure (not shown) including a series of vertical grooves and ridges can extend along the outer surface of the top cover 86.

Figure 11:
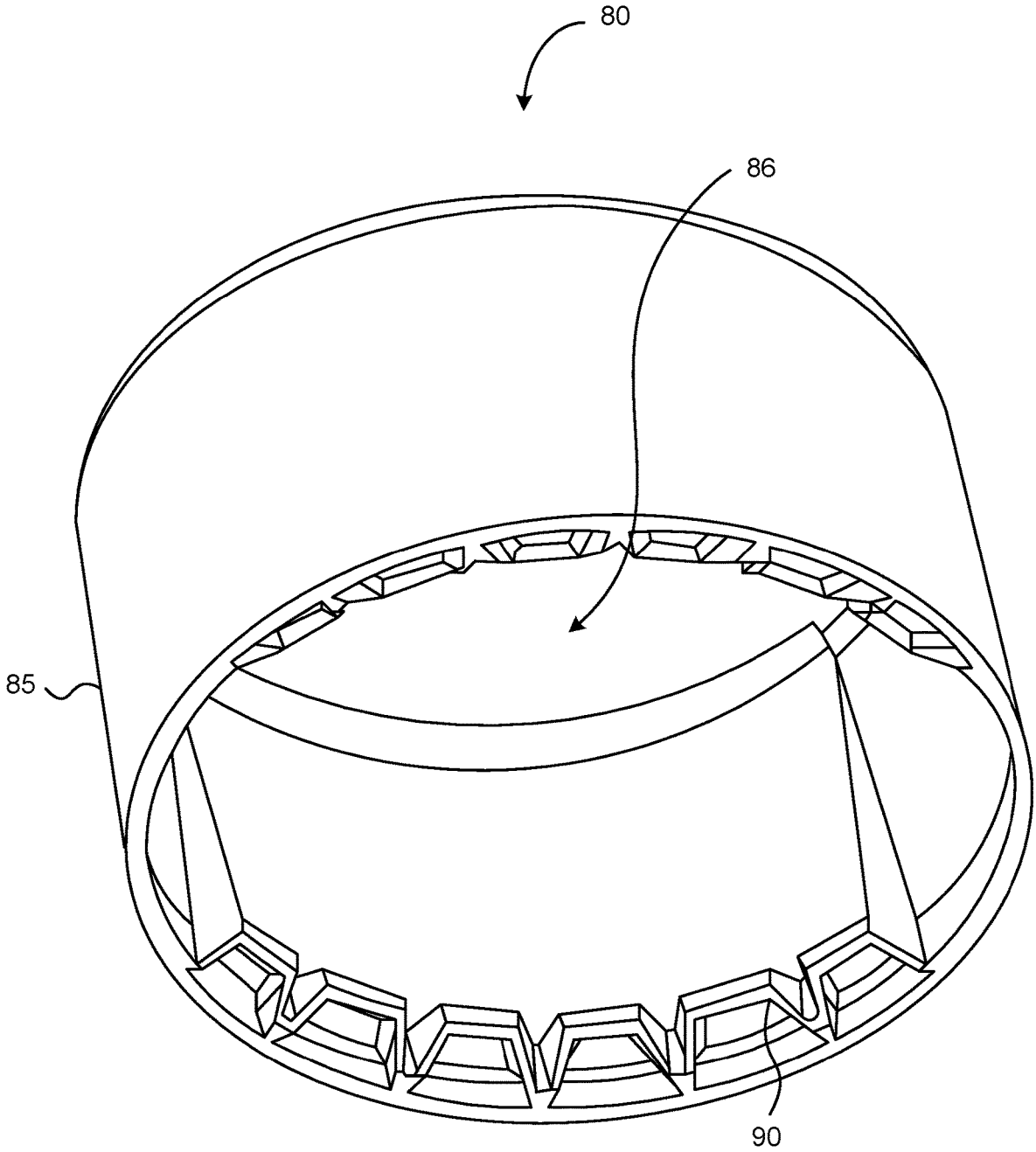
FIG. 11 is a block diagram showing, by way of example, a bottom perspective view of the further child-resistant bottle cap overshell of FIG. 10.

When viewed from the bottom, ridges along a bottom of the overshell can be viewed. FIG. 11 is a block diagram showing, by way of example, a bottom perspective view of the further child-resistant bottle cap overshell 80 of FIG. 8. From a bottom view, looking into an interior of the overshell 80, a set of ridges 90 can be viewed. The ridges 90 can function as discontinuous segments of a flange around an interior bottom side of the overshell body 85, opposite the top cover 86 and can extend around the bottom side of the body as well as extend up towards the top cover. When the overshell is placed on a bottle cap, the ridges 90 are shaped and sized to fit underneath a tamper proof ring connected to the bottle cap or the neck ring of the bottle prior to opening.

Figure 12:
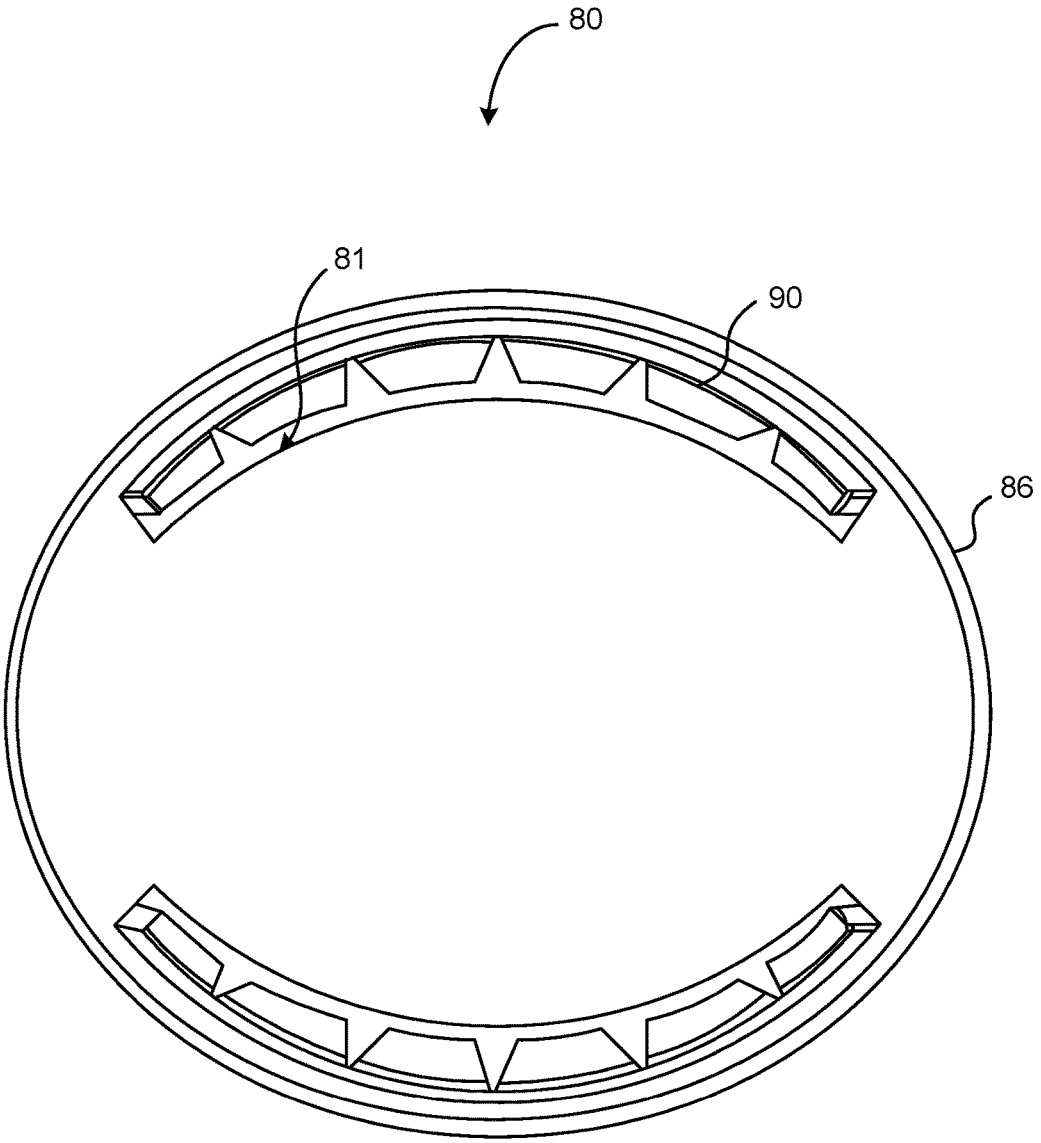
FIG. 12 is a block diagram showing, by way of example, a top view of the further child-resistant bottle cap overshell of FIG. 10.

The ridges 90 can also be seen from a top view of the overshell 80. FIG. 12 is a block diagram showing, by way of example, a top view of the further child-resistant bottle cap overshell of FIG. 10. The top cover 86 of the overshell 80 can include one or more windows 81. The windows 81 can have an arc or oval shape and be positioned along an outer edge of the top cover, close to where the top cover and body connect. When the overshell 80 is not placed over a bottle cap, the ridges 90 can be viewed through the windows 81. In one embodiment, two windows 81 are formed within the top cover 86. The windows can be the same shape and size, and can be positioned directly across from each other.

The windows 81 can allow the top cover and the body of the overshell to bend when pressure is applied. For example, during opening of a bottle cap, pressure is applied to the sides of the body positioned below a window, which allows the bottom side of the body, with the ridges to press into the bottle to open the bottle cap. The pressure on the overshell causes the overshell to change shape from, for example, an ellipse to a circle for gripping and removing the bottle cap.

Figure 13:
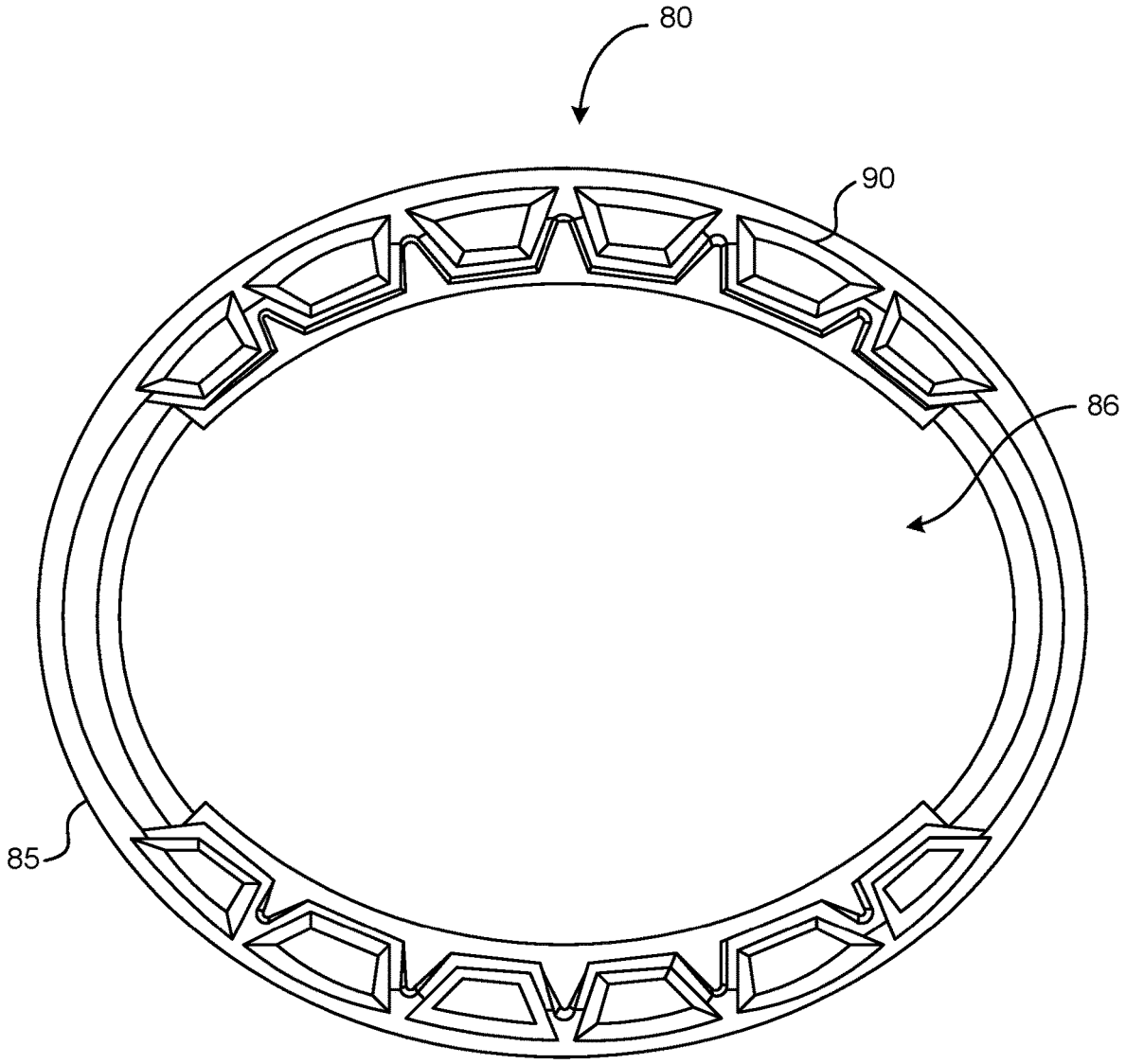
FIG. 13 is a block diagram showing, by way of example, a bottom view of the further child-resistant bottle cap overshell of FIG. 10.

In one embodiment, the ridges 90 can be shaped as a trapezoid, such as an isosceles trapezoid; however, other shapes are possible. FIG. 13 is a block diagram showing, by way of example, a bottom view of the further child-resistant bottle cap overshell 80 of FIG. 10. The ridges 90 extend from an inner surface of a bottom side of the overshell 80 body 85, opposite the top cover 86. Each individual segment of the ridges 90 can have the shape or different shapes. The shapes can include trapezoids, squares, triangles, or other types of shapes. In a further embodiment, a flange can be located below the ridges to secure the overshell to the bottle, as described above.

Figure 14:
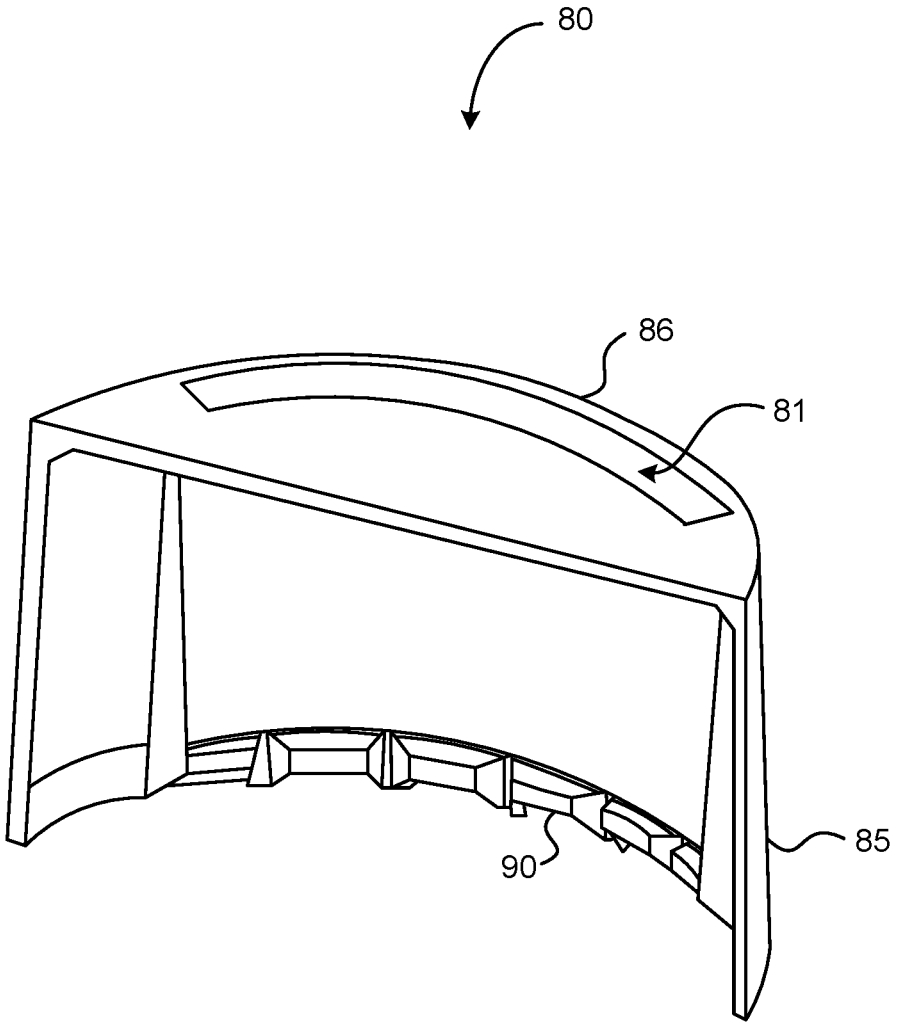
FIG. 14 is a block diagram showing, by way of example, a cross-sectional view of the further child-resistant bottle cap overshell of FIG. 10.

The ridges extend from an inner surface of the body into an interior of the overshell. FIG. 14 is a block diagram showing, by way of example, a cross-sectional view of the further child-resistant bottle cap overshell of FIG. 10. The ridges 90 can be formed along a portion of or the entire interior bottom surface of the overshell body. During opening of the bottle, the sides of the body with the ridges are pressed inward towards a bottle cap to open the cap.

Each of the different configurations of the overshell can be injection molded and can be made from polyethylene or propylene, as well as from other materials.

While the invention has been particularly shown and described as referenced to the embodiments thereof, those skilled in the art will understand that the foregoing and other changes in form and detail may be made therein without departing from the spirit and scope of the invention. For example, other components and percentages by weight are possible for different variations of the lubricant composition that remain in scope of the current application and are hereby incorporated.

What is claimed is:

1. A child-resistant bottle cap overshell, comprising:

a top cover comprising a rounded shape;

a body extending from an outer perimeter of the top cover and sized to fit over a bottle cap on a bottle;

at least two cutouts formed in the top cover adjacent to the outer perimeter; and a plurality of discontinuous ridges formed on an inner surface of the body on a bottom end of the body opposite the top cover.

2. A child-resistant bottle cap overshell according to claim 1, wherein the cutouts are the same shape or different shapes.

3. A child-resistant bottle cap overshell according to claim 1, wherein the cutouts are positioned across from one another in the top cover.

4. A child-resistant bottle cap overshell according to claim 1, wherein pressure is applied to an outer surface of the body adjacent to the cutouts.

5. A child-resistant bottle cap overshell according to claim 4, wherein the ridges engage with corresponding ridges on the bottle cap to twist the bottle cap open based on the pressure.

6. A child-resistant bottle cap overshell according to claim 4, wherein a shape of the body or top cover changes due to the pressure.

7. A child-resistant bottle cap overshell according to claim 1, wherein the ridges are each shaped as one of a trapezoid, square, or triangle.

8. A child-resistant bottle cap overshell according to claim 1, wherein the ridges are formed along a portion of the bottom end or along the whole bottom end of the inner surface of the body.

9. A child-resistant bottle cap overshell according to claim 1, wherein the body and top cover are each made from polyethylene or propylene.

10. A child-resistant bottle cap overshell according to claim 1, wherein the ridges fit underneath the bottle cap to prevent removal of the body and top cover from the bottle.

11. A method for constructing a child-resistant bottle cap overshell, comprising:

forming a top cover comprising a rounded shape;

affixing a body to an outer perimeter of the top cover, wherein the body extends away from the top cover and is sized to fit over a bottle cap on a bottle;

forming at least two cutouts within the top cover adjacent to the outer perimeter; and affixing a plurality of discontinuous ridges on an inner surface of the body on a bottom end of the body opposite the top cover.

12. A method according to claim 11, wherein the cutouts are the same shape or different shapes.

13. A method according to claim 11, wherein the cutouts are positioned across from one another in the top cover.

14. A method according to claim 11, wherein pressure is applied to an outer surface of the body adjacent to the cutouts.

15. A method according to claim 14, wherein the ridges engage with corresponding ridges on the bottle cap to twist the bottle cap open based on the pressure.

16. A method according to claim 14, wherein a shape of the body or top cover changes due to the pressure.

17. A method according to claim 11, wherein the ridges are each shaped as one of a trapezoid, square, or triangle.

18. A method according to claim 11, wherein the ridges are formed along a portion of the bottom end or along the whole bottom end of the inner surface of the body.

19. A method according to claim 11, wherein the body and top cover are each made from polyethylene or propylene.

20. A method according to claim 11, wherein the ridges fit underneath the bottle cap to prevent removal of the body and top cover from the bottle.

* * * * *